US005785582A

United States Patent [19]

Stefanik et al.

[11] Patent Number: 5,785,582

[45] Date of Patent: Jul. 28, 1998

[54] SPLIT ABRASIVE FLUID JET MIXING TUBE AND SYSTEM

[75] Inventors: Thomas J. Stefanik, Maple Valley; Edmund Y. Ting; Chidambaram Raghavan, both of Kent, all of Wash.

[73] Assignee: Flow International Corporation, Kent, Wash.

[21] Appl. No.: 577,271

[22] Filed: Dec. 22, 1995

[51] Int. Cl.[6] ..... B23P 11/02; B24C 3/02; B24C 5/04

[52] U.S. Cl. ..... 451/102; 451/90; 29/890.143; 29/447; 29/463

[58] Field of Search ..... 29/890.142, 890.143, 29/463, 447; 239/336, 428, 379, 429, 430, 433; 417/151; 451/90, 91, 102

[56] References Cited

U.S. PATENT DOCUMENTS

| | | | |
|---|---|---|---|
| 1,703,029 | 2/1929 | Fairchild | 451/102 |
| 1,988,432 | 1/1935 | Gillett et al. | 451/102 |
| 2,332,407 | 10/1943 | Spenle | 451/102 |
| 3,228,147 | 1/1966 | Moore | 451/102 |
| 3,344,558 | 10/1967 | Kirkland | 451/102 |
| 3,419,220 | 12/1968 | Goodwin et al. | 451/102 X |
| 4,545,157 | 10/1985 | Saurwein . | |
| 4,815,241 | 3/1989 | Woodson | 451/102 |
| 4,941,298 | 7/1990 | Fernwood et al. | 451/90 |
| 5,144,766 | 9/1992 | Hashish et al. | 451/102 |
| 5,155,946 | 10/1992 | Domann | 451/102 X |
| 5,283,990 | 2/1994 | Shank, Jr. | 451/102 X |
| 5,311,654 | 5/1994 | Cook | 29/447 |
| 5,421,766 | 6/1995 | Shank, Jr. | 451/102 X |

*Primary Examiner*—Timothy V. Eley
*Attorney, Agent, or Firm*—Seed and Berry LLP

[57] ABSTRACT

An improved mixing tube for use in a high-pressure abrasive fluid jet system is shown and described. In a preferred embodiment, the mixing tube is provided by forming a first piece and a second piece, each piece having a length that is substantially equal to the length of the mixing tube. A longitudinal groove is provided in each piece, the longitudinal groove extending from a first end to a second end of each piece. The first and second pieces are coupled together, such that the first and second longitudinal grooves meet to form a bore that extends longitudinally through the length of the mixing tube. Although the first and second pieces may be joined in a variety of ways, in a preferred embodiment, the two pieces are joined by shrink fitting a metal sheath around the outer surface of each piece. The first and second pieces are made of a hard ceramic material, and the longitudinal grooves are formed by grinding the pieces to remove material along their length. In this manner, any desired geometry of the bore may be achieved by varying the amount of material removed from each piece. To further increase the life of the mixing tube, each of the first and second longitudinal bores is coated prior to being coupled together, the longitudinal grooves being coated using conventional CVD techniques.

20 Claims, 3 Drawing Sheets

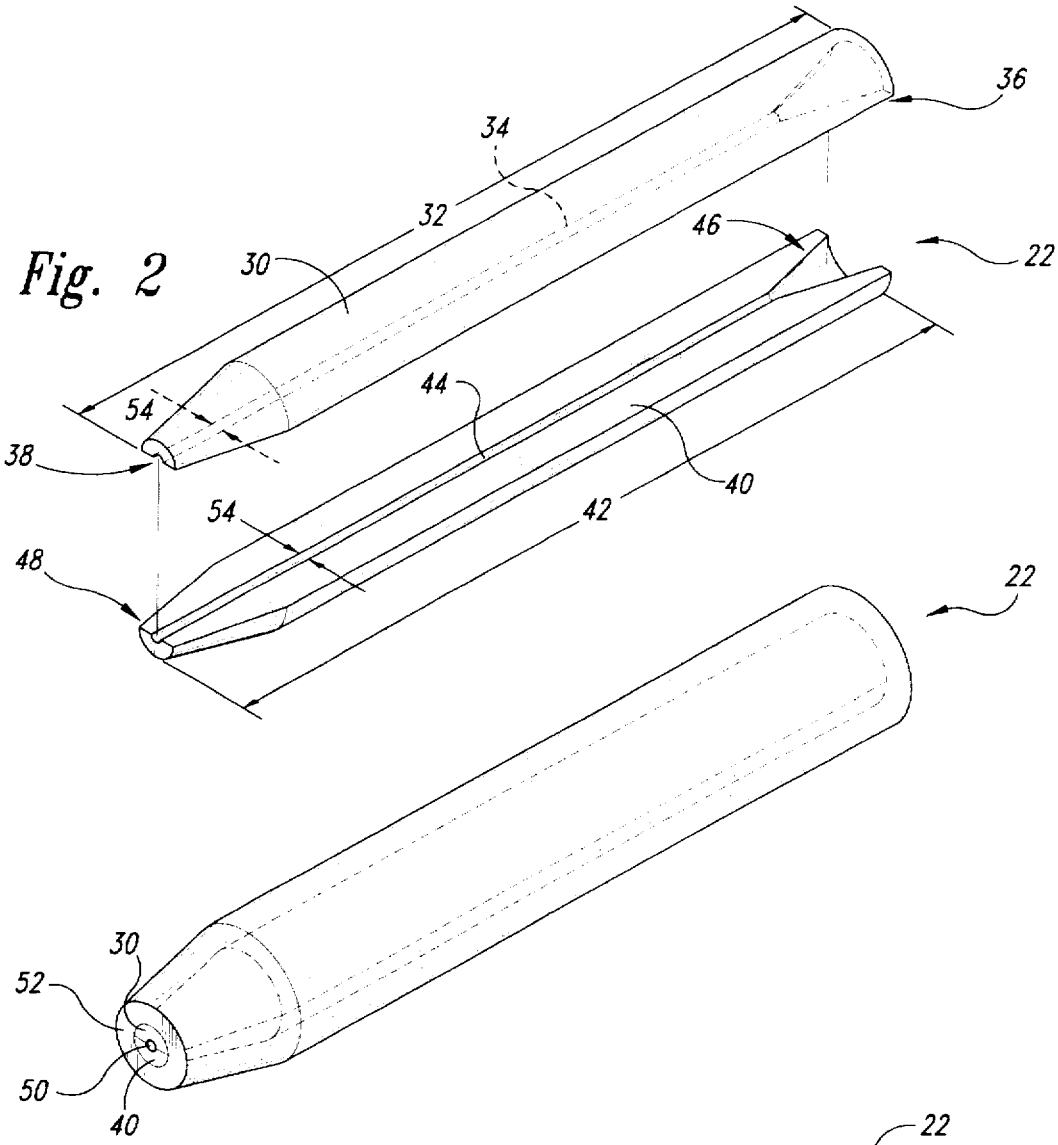
Fig. 2
Fig. 3
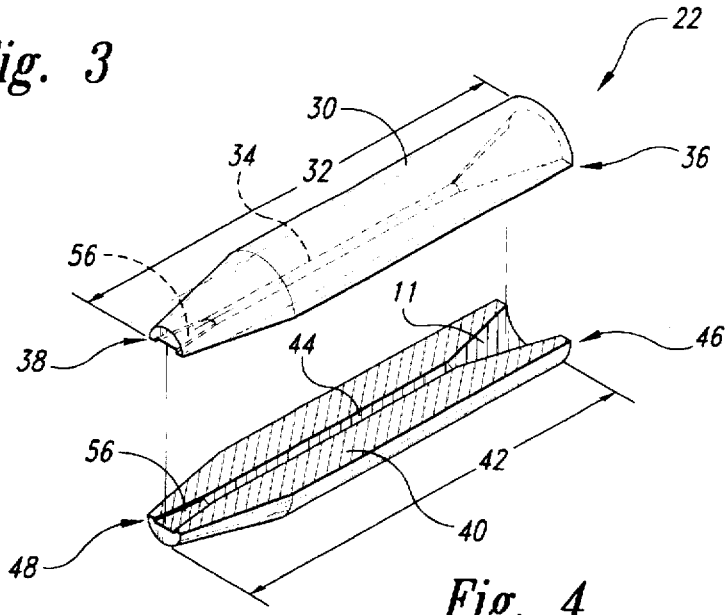
Fig. 4

SPLIT ABRASIVE FLUID JET MIXING TUBE AND SYSTEM

TECHNICAL FIELD

This invention relates to mixing tubes for use in a high-pressure abrasive fluid jet system, and more particularly, to an improved method for making such a mixing tube.

BACKGROUND OF THE INVENTION

The cutting of numerous types of materials, for example, glass, metal, or ceramics, may be accomplished through use of a high-pressure abrasive fluid jet that is generated by mixing abrasive particles, for example, garnet, with a high-pressure fluid jet. Although different fluids may be used, high-pressure fluid jets are typically water, and are generated by high-pressure, positive displacement pumps that can pressurize water to 2,000–75,000 psi.

To generate the high-pressure abrasive fluid jet, a volume of high-pressure fluid is typically forced through a high-pressure orifice provided in a cutting head, thereby generating a high-pressure fluid jet. The high-pressure fluid jet passes through a mixing chamber into which a volume of abrasive is introduced, the abrasive and the high-pressure fluid jet being mixed and discharged as an abrasive fluid jet through a mixing tube. The abrasive particles are accelerated by the water jet to supersonic velocities within the mixing tube, thereby resulting in wear and damage to an inner surface of the mixing tube.

Although currently available mixing tubes have an acceptably long life, applicants believe it is possible and desirable to provide an improved mixing tube.

SUMMARY OF THE INVENTION

It is therefore an object of this invention to provide an improved mixing tube for use in an abrasive fluid jet system.

It is another object of this invention to provide a more simple and cost-effective method for making a mixing tube for an abrasive fluid jet system.

It is another object of this invention to provide a mixing tube for use in an abrasive fluid jet system that will resist wear better and have a longer life than currently available mixing tubes.

These and other objects of the invention, as will be apparent herein, are accomplished by providing an improved mixing tube for an abrasive fluid jet system. In a preferred embodiment, a mixing tube is provided by forming a first piece and a second piece, each piece having a longitudinal groove that extends from a first end to the second end of the piece. The two pieces are coupled together, thereby forming the mixing tube, the first and second grooves meeting to form a longitudinal bore that extends through the length of the mixing tube. Although the two pieces may be coupled together in a variety of ways, in a preferred embodiment, they are joined by shrink fitting a metal sheath around the outer surface of the first and second pieces.

Several advantages are achieved by providing a mixing tube in accordance with a preferred embodiment of the present invention. More particularly, the current method of manufacturing mixing tubes uses electrode discharge machining (EDM) to remove material from a blank to form the bore of the mixing tube. However, EDM may be used only with electrically conductive materials, for example, tungsten carbide. By providing a mixing tube in accordance with the present invention, harder and non-electrically conductive materials, such as ceramics, may be used, thereby extending the life of the mixing tube. Therefore, in a preferred embodiment, each piece of the mixing tube is made of a hard ceramic material, and the first and second longitudinal grooves are formed by grinding each piece to remove material along the length of the piece.

By providing a mixing tube in accordance with a preferred embodiment of the present invention, it is also possible to vary the internal geometry of the mixing tube, which is not possible with currently available methods of manufacture. Therefore, although a uniform portion of each piece may be removed along the length of each piece, thereby resulting in a bore having a uniform diameter, it is also possible to vary the geometry, for example, removing an increasing amount of material from each piece near the second end of each piece, such that the bore has a fan-shaped cross-section near the second end of the mixing tube. (It will be understood that a bore having any desired cross-section may be formed in accordance with a preferred embodiment of the present invention.)

Furthermore, in a preferred embodiment, each piece of the mixing tube is coated prior to the two pieces being coupled together to form the mixing tube, thereby making the bore harder and more wear resistant. In a preferred embodiment, any conventional chemical vapor deposition (CVD) technique may be used, for example, to apply a diamond coating. In an alternative embodiment, hot flame deposition techniques may be used.

BRIEF DESCRIPTION OF THE DRAWINGS

FIG. 2 is an exploded view of a mixing tube provided in accordance with a preferred embodiment of the present invention for use in the abrasive fluid jet system of FIG. 1.

FIG. 3 is a front isometric view of the mixing tube of FIG. 2, assembled.

FIG. 4 is an exploded view of an alternative embodiment of the mixing tube illustrated in FIG. 2.

DETAILED DESCRIPTION OF THE INVENTION

Figure 1:
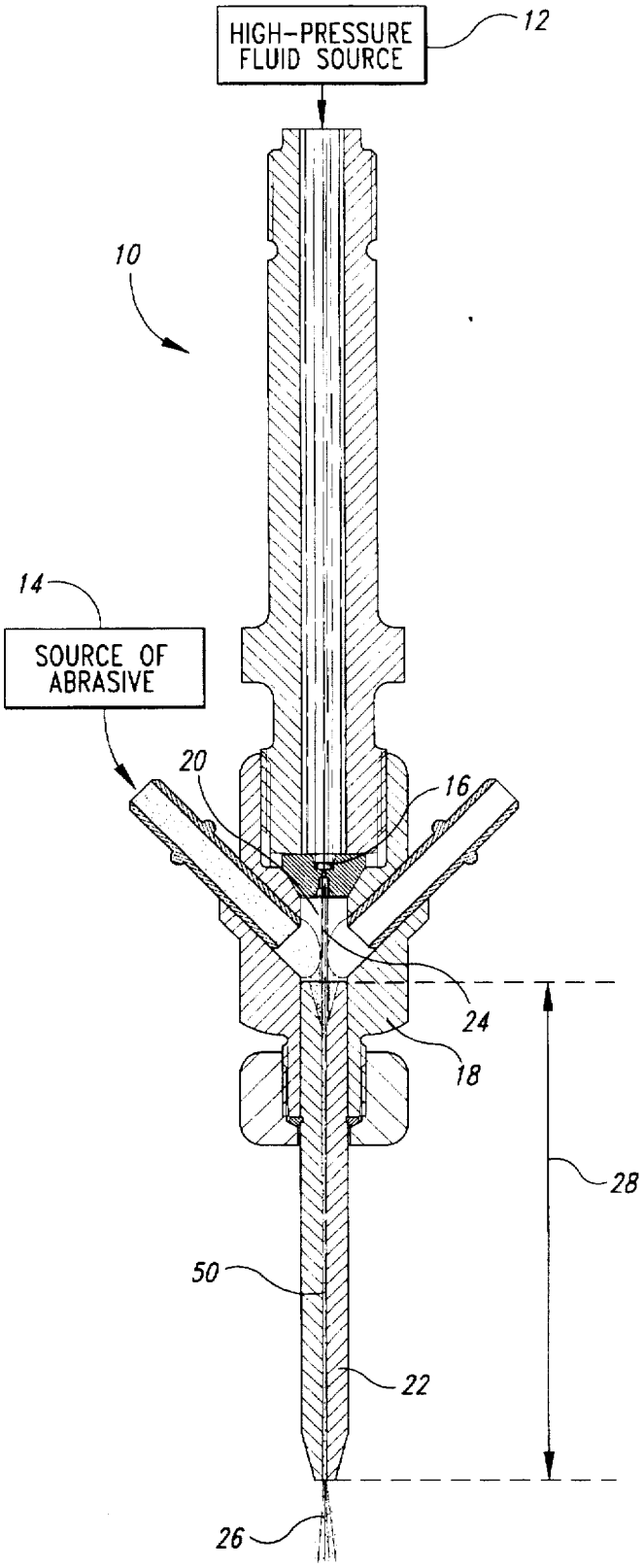
FIG. 1 is a cross-sectional elevational view of an abrasive water jet system.

In cutting certain materials, it is often advantageous to use a high-pressure abrasive fluid jet. As illustrated in FIG. 1, a high-pressure abrasive fluid jet is generated by an abrasive fluid jet system 10. A high-pressure fluid source 12 provides a volume of high-pressure fluid, typically water, that flows through orifice 16 provided in cutting head 18 to form high-pressure fluid jet 24. As the high-pressure fluid jet 24 passes through mixing chamber 20 of cutting head 18, a volume of abrasive from a source of abrasive 14 is introduced into the mixing chamber 20, where it is entrained by the high-pressure fluid jet 24. The abrasive particles are mixed with the high-pressure fluid jet 24 and accelerated to supersonic velocities within a bore 50 of mixing tube 22, the high-pressure fluid jet and abrasive being discharged from mixing tube 22 as a high-pressure abrasive fluid jet 26.

Figure 5:
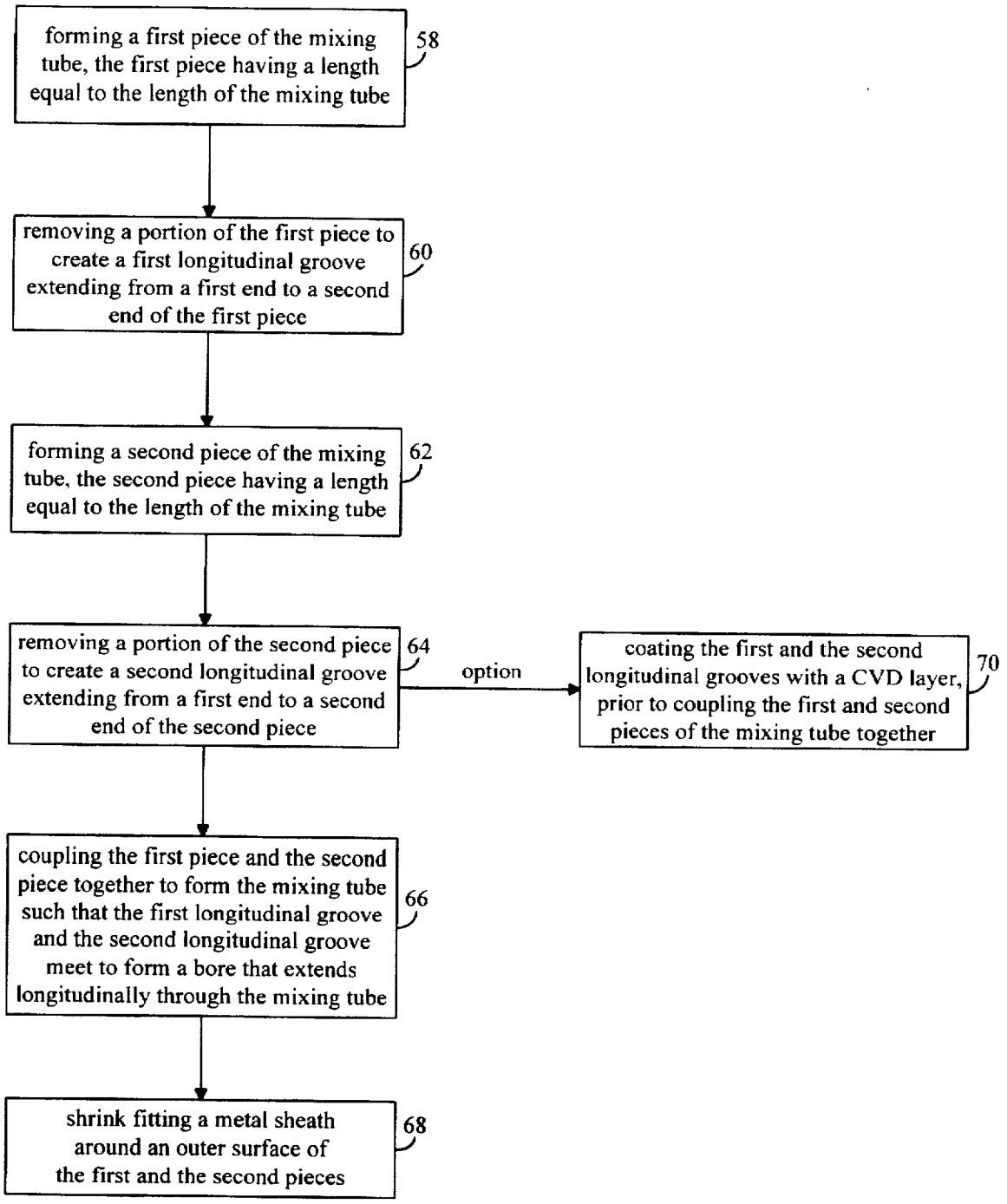
FIG. 5 is a schematic illustration of a preferred embodiment of the present invention.

As discussed above, the abrasive particles are accelerated to high velocities in the mixing tube, thereby resulting in wear and damage to the bore of the mixing tube. An improved mixing tube 22 is provided in accordance with a preferred embodiment of the present invention, as illustrated in FIGS. 2 and 5, by forming a first piece 30 having a length 32 equal to a length 28 of mixing tube 22, step 58. A portion of the first piece 30 is removed, step 60, to create a first longitudinal groove 34 that extends from a first end 36 to a second end 38 of the first piece 30.

Similarly, a second piece 40 of mixing tube 22 is formed, having a length 42 equal to the length 28 of mixing tube 22, step 62. A portion of the second piece 40 is removed, step 64, to create a second longitudinal groove 44 that extends from a first end 46 to a second end 48 of the second piece 40. The first piece 30 and the second piece 40 are coupled together, step 66, to form the mixing tube 22, such that the first longitudinal groove 34 and the second longitudinal groove 44 meet to form a bore 50 that extends longitudinally through the mixing tube. In a preferred embodiment, the mixing tube has a length of 1–10 inches and an inner diameter of 0.01–0.25 inch. Although the two pieces have been illustrated in FIGS. 2–4 as being symmetrical, it will be understood that this is not required.

Although the first piece 30 and second piece 40 may be coupled together in a variety of ways, in a preferred embodiment as illustrated in FIG. 3, a metal sheath 52 made of a high strength material such as steel is shrink fitted around the first and second pieces, step 68, to solidly join the two pieces together to form mixing tube 22. (For example, a thick wall metal sleeve may be heated and clamped around the two pieces.)

In a preferred embodiment, the first and second pieces are formed from a hard ceramic material and the first and second longitudinal grooves 34 and 44 are formed by grinding away material along the length of the first and second pieces 30 and 40, respectively. Conventional mixing tube materials have a high hardness and toughness, which is necessary for good wear resistance. For example, tungsten carbide is a conventionally used material and has a hardness of 2600 HV and a toughness of 5 $MPA \times m^{1/2}$. However, it is believed that preferred results are achieved through use of a hard ceramic material, and preferably, through use of a nanometer size microstructure ceramic, made using nanometer-size powder technology. Nano-size ceramics are harder and tougher than conventional materials, and it is therefore believed that use of this type of ceramic will result in superior results.

To further increase the wear resistance of the mixing tube 22, the first and second longitudinal grooves 34 and 44 are coated, step 70, prior to coupling the first and second pieces of the mixing tube together. Although a variety of coatings may be used, in a preferred embodiment, conventional chemical vapor deposition (CVD) is used, for example, to provide a diamond coating 11 on the grooves. The CVD coating may be used regardless of whether the mixing tube is made of conventional materials or of ceramic.

In a preferred embodiment, an equal portion of the first piece is removed along the length of the first piece near the second end of the first piece, thereby causing the first longitudinal groove 34 to have a constant width 54 near the second end 38 of first piece 30. Similarly, a uniform portion of second piece 40 is removed along a length of the second piece near the second end 48, such that the second longitudinal groove 44 has a constant width 54 near the second end 48 of second piece 40. As a result, when the first and second pieces are coupled together, the bore 50 has a constant diameter near the second end of the mixing tube.

In an alternative embodiment, an increasing portion of the first and second pieces near the second end of each piece is removed, as illustrated in FIG. 4, such that the first and second longitudinal bores 34 and 44 have a fan shape 56 at the second end of each piece. It is further noted that the geometry of the bore and mixing tube may change along the length of the mixing tube, for example, each of the grooves may transition from a circular entry at a first end 46 of each piece to a flat outlet at a second end 48 of each piece. As a result, the bore of the mixing tube 22 has a fan-shaped cross-section at its second end, thereby generating a linear abrasive spray pattern. Although two bore geometries have been described for purposes of illustration, it will be understood that any desired geometry may be formed in the first and second pieces of the mixing tube.

An improved mixing tube and method for making the mixing tube, for use in an abrasive fluid jet system, have been shown and described. From the foregoing, it will be appreciated that although embodiments of the invention have been described herein for purposes of illustration, various modifications may be made without deviating from the spirit of the invention. Thus, the present invention is not limited to the embodiments described herein, but rather is defined by the claims which follow.

We claim:

1. A mixing tube for use in a high pressure system for generating high pressure abrasive fluid jets, the mixing tube comprising:

a first longitudinal piece having a first groove extending from a first end to a second end of the first piece;

a second longitudinal piece having a second groove extending from a first end to a second end of the second piece;

outer securing means coupled to an outer surface of the first piece and an outer surface of the second piece to couple the first and second pieces together; and wherein the first piece and the second piece together form the mixing tube such that the first groove and the second groove meet to form a bore extending longitudinally through the mixing tube.

2. The mixing tube according to claim 1 wherein a length of the first longitudinal piece and a length of the second longitudinal piece are both equal to a length of the mixing tube.

3. The mixing tube according to claim 1 wherein the outer securing means comprises a metal sheath coupling provided around the outer surface of the first and second pieces to clamp the first and second pieces together.

4. The mixing tube according to claim 1 wherein the first and second pieces are made of a ceramic material.

5. The mixing tube according to claim 1 wherein the first groove has a constant width along the length of the first piece near the second end of the first piece and the second groove has a constant width along the length of the second piece near the second end of the second piece, such that when the first and second pieces are coupled together, the bore has a constant diameter through the length of the mixing tube near the second end of the first piece and the second end of the second piece.

6. The mixing tube according to claim 1 wherein a width of the first groove flares near the second end of the first piece and a width of the second groove flares near the second end of the second piece, such that when the first and second pieces are coupled together, the bore has a fan-shaped cross-section near the second end of the first piece and the second end of the second piece.

7. The mixing tube according to claim 1, further comprising a hardening, wear-resistant layer provided on each of the first and second grooves.

8. The mixing tube according to claim 1 wherein the bore has a desired cross-sectional shape.

9. The mixing tube according to claim 1 wherein the desired cross-sectional shape is substantially circular.

10. The mixing tube according to claim 1 wherein the desired cross-sectional shape is substantially rectangular.

11. A mixing tube for use in a high pressure system for generating high pressure abrasive fluid jets, the mixing tube comprising;

a first longitudinal piece having a first groove extending from a first end to a second end of the first piece;

a second longitudinal piece having a second groove extending from a first end to a second end of the second piece;

a metal sheath coupling provided around an outer surface of the first and second pieces to clamp the first and second pieces together; and wherein the first piece and the second piece together form the mixing tube such that the first groove and the second groove meet to form a bore extending longitudinally through the mixing tube.

12. The mixing tube according to claim 11 wherein a length of the first longitudinal piece and a length of the second longitudinal piece are both equal to a length of the mixing tube.

13. The mixing tube according to claim 11 wherein the first and second pieces are made of a ceramic material.

14. The mixing tube according to claim 11 wherein the first groove has a constant width along the length of the first piece near the second end of the first piece and the second groove has a constant width along the length of the second piece near the second end of the second piece, such that when the first and second pieces are coupled together, the bore has a constant diameter through the length of the mixing tube near the second end of the first piece and the second end of the second piece.

15. The mixing tube according to claim 11 wherein the width of the first groove flares near the second end of the first piece and a width of the second groove flares near the second end of the second piece, such that when the first and second pieces are coupled together, the bore has a fan-shaped cross-section near the second end of the first piece and the second end of the second piece.

16. The mixing tube according to claim 11 further comprising a hardening, wear-resistant layer provided on each of the first and second grooves.

17. The mixing tube according to claim 11 wherein the bore has a desired cross-sectional shape.

18. The mixing tube according to claim 17 wherein the desired cross-sectional shape is substantially circular.

19. The mixing tube according to claim 12 wherein the desired cross-sectional shape is substantially rectangular.

20. An abrasive fluid jet system comprising:

a source of high-pressure fluid;

a source of abrasive;

a cutting head having a high-pressure orifice through which a volume of high-pressure fluid is forced to form a high-pressure fluid jet, and having a mixing chamber into which the high-pressure fluid jet and a volume of abrasive are introduced; and a mixing tube coupled to the mixing chamber, the mixing tube being comprised of a first piece having a first groove extending longitudinally from a first end to a second end of the first piece, and a second piece provided with a groove extending longitudinally from a first end to a second end of the second piece, the first and the second pieces being coupled together with a metal sheath coupling provided around an outer surface of the first and second pieces to form the mixing tube such that the first groove and the second groove meet to form a bore extending through the mixing tube, the abrasive and the high-pressure fluid jet being mixed and discharged through the bore of the mixing tube as an abrasive fluid jet.

* * * * *